US008233016B2

(12) United States Patent
Sakai et al.

(10) Patent No.: US 8,233,016 B2
(45) Date of Patent: Jul. 31, 2012

(54) IMAGE FORMING APPARATUS, AND EXPOSURE CONTROL METHOD THEREFOR

(75) Inventors: Tetsuya Sakai, Hoi-gun (JP); Katsuyuki Hirata, Toyokawa (JP); Tatsuya Isono, Toyohashi (JP); Takashi Harashima, Toyokawa (JP); Toshio Tsuboi, Okazaki (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 1189 days.

(21) Appl. No.: 11/374,168

(22) Filed: Mar. 14, 2006

(65) Prior Publication Data

US 2007/0085893 A1 Apr. 19, 2007

(30) Foreign Application Priority Data

Oct. 17, 2005 (JP) ..... 2005-301639

(51) Int. Cl.
*B41J 2/385* (2006.01)

(52) U.S. Cl. ..... 347/132

(58) Field of Classification Search ..... 347/132, 347/236, 233, 133; 355/32
See application file for complete search history.

(56) References Cited

U.S. PATENT DOCUMENTS

| | | | | |
|---|---|---|---|---|
| 5,438,437 | A * | 8/1995 | Mizoguchi et al. | 358/518 |
| 6,278,477 | B1 * | 8/2001 | Ohba | 347/251 |
| 6,418,280 | B2 * | 7/2002 | Kamiya | 399/46 |
| 6,614,506 | B2 * | 9/2003 | Kodama et al. | 355/32 |
| 6,750,892 | B2 * | 6/2004 | Suzuki | 347/133 |
| 7,027,139 | B2 * | 4/2006 | Ogihara et al. | 356/218 |
| 2006/0092264 | A1 * | 5/2006 | Matsuzaki et al. | 347/233 |

FOREIGN PATENT DOCUMENTS

| | | | |
|---|---|---|---|
| JP | 2001-341346 A | | 12/2001 |
| JP | 2001341346 | * | 12/2001 |
| JP | 2003-226041 A | | 8/2003 |
| JP | 2003226041 | * | 8/2003 |
| JP | 2004-021139 | | 1/2004 |
| JP | 2004-074518 A | | 3/2004 |
| JP | 2004074518 | * | 3/2004 |

OTHER PUBLICATIONS

Office Action dated Jan. 6, 2009 in corresponding Japanese Application No. 2005-301639 filed Oct. 17, 2005 and English translation.

* cited by examiner

*Primary Examiner* — Stephen Meier
*Assistant Examiner* — Carlos A Martinez
(74) *Attorney, Agent, or Firm* — Buchanan Ingersoll & Rooney PC

(57) ABSTRACT

An image forming apparatus of the invention includes an image carrier, an exposure device performing exposure for forming a toner image on a surface of the image carrier and having at least a first exposure light source and a second exposure light source, a sensor for detecting specified patterns, which are formed on the image carrier at a specified time with use of the first and second exposure light sources, a storing unit for storing a correlation, which is attained from a detection result by the sensor, between the first and second exposure light sources, and a controller for controlling the first and second exposure light sources based on the correlation.

14 Claims, 5 Drawing Sheets

IMAGE FORMING APPARATUS, AND EXPOSURE CONTROL METHOD THEREFOR

RELATED APPLICATION

This application is based on Japanese Patent Application No. 2005-301639, the content of which is incorporated herein by reference.

BACKGROUND OF THE INVENTION

The present invention relates to an electrophotographic image forming apparatus and an exposure method therefor.

Apparatuses conventionally known as electrophotographic image forming apparatuses include those executing image stabilization control composed of forming a plurality of specified toner patterns with varied intensities of laser emission from a laser diode (LD) serving as an exposure light source of an exposure device, detecting the density of each toner pattern by a sensor, attaining the relation between the laser emission intensity and the toner density based on attained detection results, and determining an optimum intensity of light emission which makes it possible to provide an optimum density based on the attained relation, and executing image formation with the determined optimum intensity of light emission in the subsequent printing operation (see JP 2004-21139A).

In recent years, image forming apparatuses having two exposure light sources in an exposure device for forming electrostatic latent images on photoreceptors by simultaneously emitting light from the respective exposure light sources in order to increase a printing speed have been put to practical use. In this type of image forming apparatuses, if dots formed on the photoreceptor by the respective exposure light sources have variations between the respective exposure light sources, then image noise is generated particularly in the case of forming halftone images.

SUMMARY OF THE INVENTION

An object of the present invention is to provide an image forming apparatus and an exposure control method therefor, which can suppress generation of image noise by optimum exposure control.

In order to accomplish the object, an image forming apparatus of the present invention includes an image carrier, an exposure device which performs exposure for forming a toner image on a surface of the image carrier and has at least a first exposure light source and a second exposure light source, a sensor for detecting specified patterns, which are formed on the image carrier at a specified time with use of the first and second exposure light sources, a storing unit for storing a correlation, which is attained from a detection result by the sensor, between the first and second exposure light sources, and a controller for controlling the first and second exposure light sources based on the correlation.

In the image forming apparatus of the present invention, a correction pattern may be formed with use of the first exposure light source, the correction pattern may be detected by the sensor, a control value for the first exposure light source may be determined based on the detection result by the sensor, and a control value for the second exposure light source may be determined based on the control value for the first exposure light source in conformity with the attained correlation.

Moreover, in the image forming apparatus of the present invention, the specified patterns may be toner patterns, and the sensor may be a reflective photosensor for detecting densities of the toner patterns.

Moreover, in the image forming apparatus of the present invention, the specified patterns may be electrostatic latent images, and the sensor may be a potential sensor for detecting potential of the electrostatic latent images.

Moreover, in the image forming apparatus of the present invention, the specified time may be a time corresponding to at least one of a time when an image carrier has been replaced, a time when a long operation time has passed and a time when surrounding environment has changed beyond a specified value.

Moreover, in the image forming apparatus of the present invention, control of the first and second exposure light sources may be control of an intensity of light emission.

Further, in the image forming apparatus of the present invention, the image carrier may be a photoreceptor or a transfer body.

An exposure control method for an image forming apparatus of the present invention is an exposure control method for an image forming apparatus having an exposure device which performs exposure for forming a toner image on a surface of an image carrier and has at least a second exposure light source and a second exposure light source, including the steps of forming specified patterns on the image carrier at a specified time with use of the first and second exposure light sources, detecting the respective patterns by a sensor, storing a correlation, which is attained from a detection result by the sensor, between the first and second exposure light sources, and controlling the first and second exposure light sources based on the correlation.

The exposure control method for an image forming apparatus of the present invention may further include the steps of forming a correction pattern with use of the first exposure light source, detecting the correction pattern by the sensor, determining a control value for the first exposure light source based on the detection result by the sensor, and determining a control value for the second exposure light source based on the control value for the first exposure light source in conformity with the attained correlation.

Moreover, in the exposure control method for an image forming apparatus of the present invention, the specified patterns may be toner patterns, and the sensor may be a reflective photosensor for detecting densities of the toner patterns.

Moreover, in the exposure control method for an image forming apparatus of the present invention, the specified patterns may be electrostatic latent images, and the sensor may be a potential sensor for detecting potential of the electrostatic latent images.

Moreover, in the exposure control method for an image forming apparatus of the present invention, the specified time may be a time corresponding to at least one of a time when an image carrier has been replaced, a time when a long operation time has passed and a time when surrounding environment has changed beyond a specified value.

Moreover, in the exposure control method for an image forming apparatus of the present invention, control of the first and second exposure light sources may be control of an intensity of light emission.

Further, in the exposure control method for an image forming apparatus of the present invention, the image carrier may be a photoreceptor or a transfer body.

According to the image forming apparatus and the exposure control method therefor in the present invention, for example, detecting the toner density of each pattern formed by a plurality of exposure light sources and controlling the respective exposure light sources based on the detection result allows optimum control of the respective exposure light sources, which makes it possibly to eliminate dispersion of dot reproducibility on the photoreceptor in the respective exposure light sources and to prevent generation of image noise.

Moreover, by attaining the correlation between the first and the second exposure light sources based on the detection result by the sensor and storing the attained correlation, it becomes possible to form a specified pattern with use of only the first exposure light source, detect the pattern by the sensor, determine a control value for the first exposure light source based on the detection result by the sensor, and determine a control value for the second exposure light source based on the control value for the first exposure light source in conformity with the attained correlation, which eliminates the necessity of forming a toner pattern with use of the second exposure light source in the subsequent image stabilization control, thereby allowing reduction in time taken for control operation and reduction in toner consumption amount.

BRIEF DESCRIPTION OF THE DRAWINGS

The present invention will be further described with reference to the accompanying drawings wherein like reference numerals refer to like parts in the several views, and wherein.

DETAILED DESCRIPTION OF THE PREFERRED EMBODIMENTS

Figure 1:
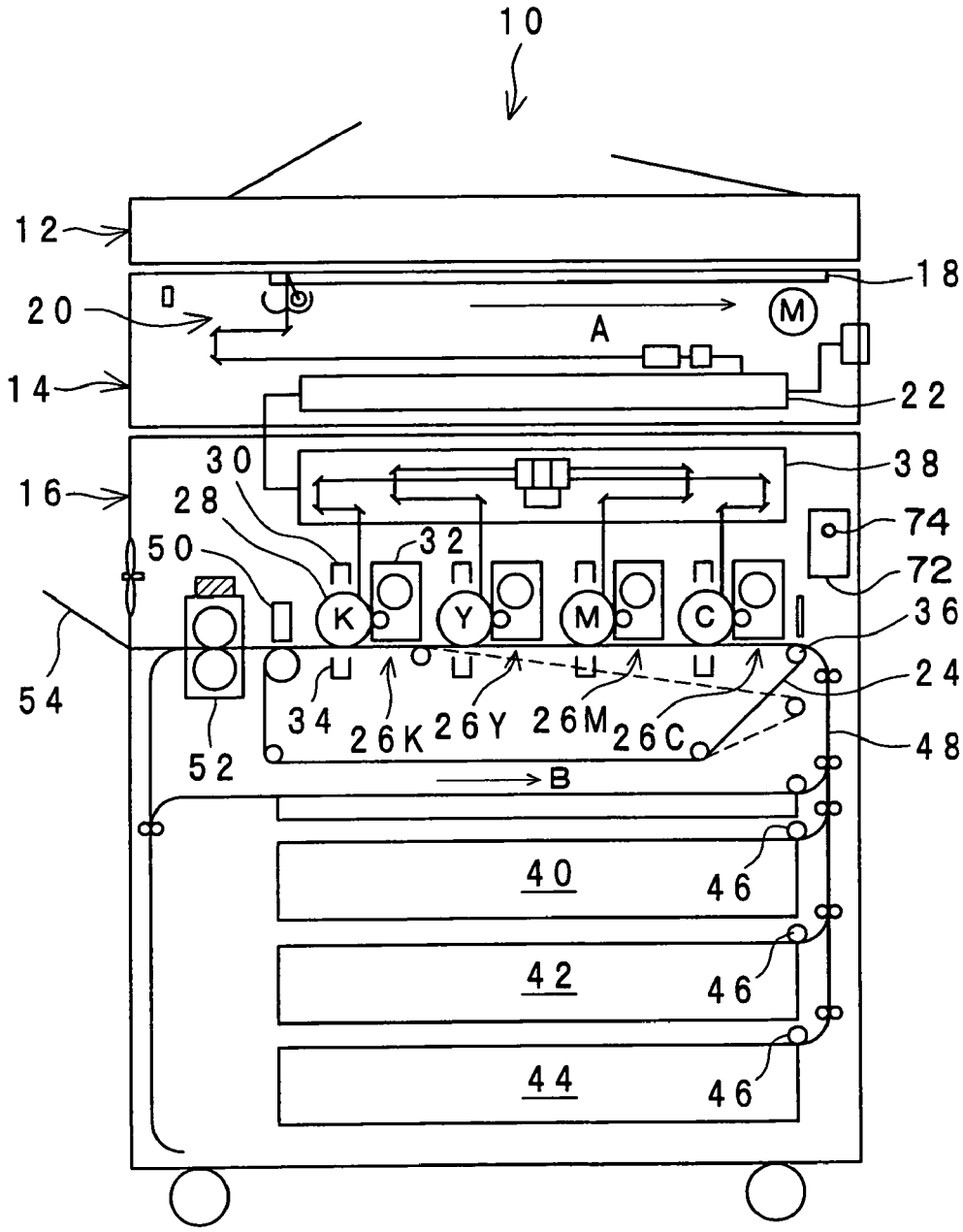
FIG. 1 is an overall structure view showing a full-color copier.

FIG. 1 is an overall structure view showing a tandem-type full-color copier 10 as an image forming apparatus in one embodiment of the present invention. The copier 10 is composed of an automatic document feed section 12, an image scanner section 14, and an image forming section 16.

The automatic document feed section 12 sequentially transports original documents loaded on its upper section one by one onto a platen glass 18 of the image scanner section 14, and transports the documents back one by one onto the upper section of the automatic document feed section 12 after document images are scanned.

The image scanner section 14 has a scanner optical system 20 and an image processing section 22. The scanner optical system 20 scans the image of a document transported onto the platen glass 18 while moving in an arrow A direction. The scanned document image data is inputted into the image processing section 22. If the inputted document image data is a color image, the image processing section 22 resolves the document image data into image data of four colors composed of cyan (hereinbelow referred to as "C"), magenta (hereinbelow referred to as "M"), yellow (hereinbelow referred to as "Y") and black (hereinbelow referred to as "K"), and each image data is subject to necessary processings such as shading correction, density conversion and edge reinforcement and is temporarily stored in an image memory (unshown). Then, the data is read out one line at a time from the image memory to be used as a drive signal to light-modulate laser diodes (hereinbelow referred to as "LDs") 56, 58 (see FIG. 2) mounted on a later-described exposure device 38 according to need.

The image forming section 16 has an endless film-shaped transfer belt (image carrier and transfer body) 24 hung over five rollers and rotationally driven in an arrow B direction. Along the upper section of the transfer belt 24 in an almost horizontal state, four image forming units 26C, 26M, 26Y, 26K each corresponding to toners of CMYK four colors are disposed abreast. It is to be noted that without being limited to being in the belt shape, the transfer body may be in a dram shape.

Since the respective image forming units 26C, 26M, 26Y, 26K have an identical structure, their structure will be described by taking the structure of the black image forming unit 26K as an example. The image forming unit 26K includes a dram-like photoreceptor (image carrier) 28. Disposed around the photoreceptor 28 are an electrifier 30 for uniformly electrifying the surface of the photoreceptor 28, a developing device 32 for developing, with a toner, an electrostatic latent image formed by laser exposure on the surface of the uniformly electrified photoreceptor 28 to produce a toner image, and a transfer charger 34 disposed across the transfer belt 24 from the photoreceptor 28 for transferring, with electrostatic force, the toner image on the photoreceptor 28 onto a paper sheet transported by the transfer belt 24. It is to be noted that without being limited to being in the dram shape, the photoreceptor 28 may be in a belt shape.

One roller 36 supporting the transfer belt 24 can move between an upper position and a lower position. When the roller 36 is in the upper position, the upper section of the transfer belt 24 is in an almost horizontal state and in contact with the respective photoreceptors 28 of the image forming units 26C, 26M, 26Y, 26K so as to constitute a color print mode. When the roller 36 is moved to the lower position, the transfer belt 24 is away from the respective photoreceptors 28 of the image forming units 26C, 26M, 26Y and only in contact with the photoreceptor 28 of the image forming unit 26K as shown by a doted line in FIG. 1 so as to constitute a monochrome print mode In the monochrome print mode, the respective transfer chargers 34 of the image forming units 26C, 26M, 26Y also retreat downward.

The exposure device 38 is disposed above the respective image forming units 26C, 26M, 26Y, 26K. The exposure device 38 performs laser exposure of the photoreceptors 28 in the respective image forming units 26C, 26M, 26Y, 26K based on each CMYK image data inputted from the image processing section 22 so as to form electrostatic latent images for the respective colors. The detailed structure of the exposure device 38 will be described later.

Three paper feed sections 40, 42, 44 are vertically disposed below the image forming section 16. As recording paper, regular paper sheets different in size for example are housed in a stacked state in the respective paper feed sections 40, 42, 44. One of the paper feed sections 40, 42, 44 is selected based on a document size, magnification and the like, and paper sheets housed in the selected paper feed section are fed one by one from the uppermost sheet to a paper transportation line 48 by a paper feed roller 46.

The paper sheets fed to the paper transportation line 48 are transported upward by a plurality of transportation rollers and retained on the surface of the transfer belt 24, before being transported by the rotating transfer belt 24.

On a lateral side of the black image forming unit 26K, a reflective photosensor (hereinbelow referred to as an "IDC sensor") 50 is disposed facing the transfer belt 24. With the IDC sensor 50, the density of a toner image on a paper sheet transported by the transfer belt 24 can be detected. A fixing device 52 for heating and fixing a toner image transferred onto a paper sheet is disposed on the lateral side of the transfer belt 24. Moreover, a paper discharge tray 54 is provided on a lateral wall of the image forming section 16.

The copier 10 further has a controller 72 which controls whole operations thereof, and the controller 72 includes a memory (storing unit) 74 which stores a correlation between two LDs 56, 58 of the exposure device 38.

Figure 2:
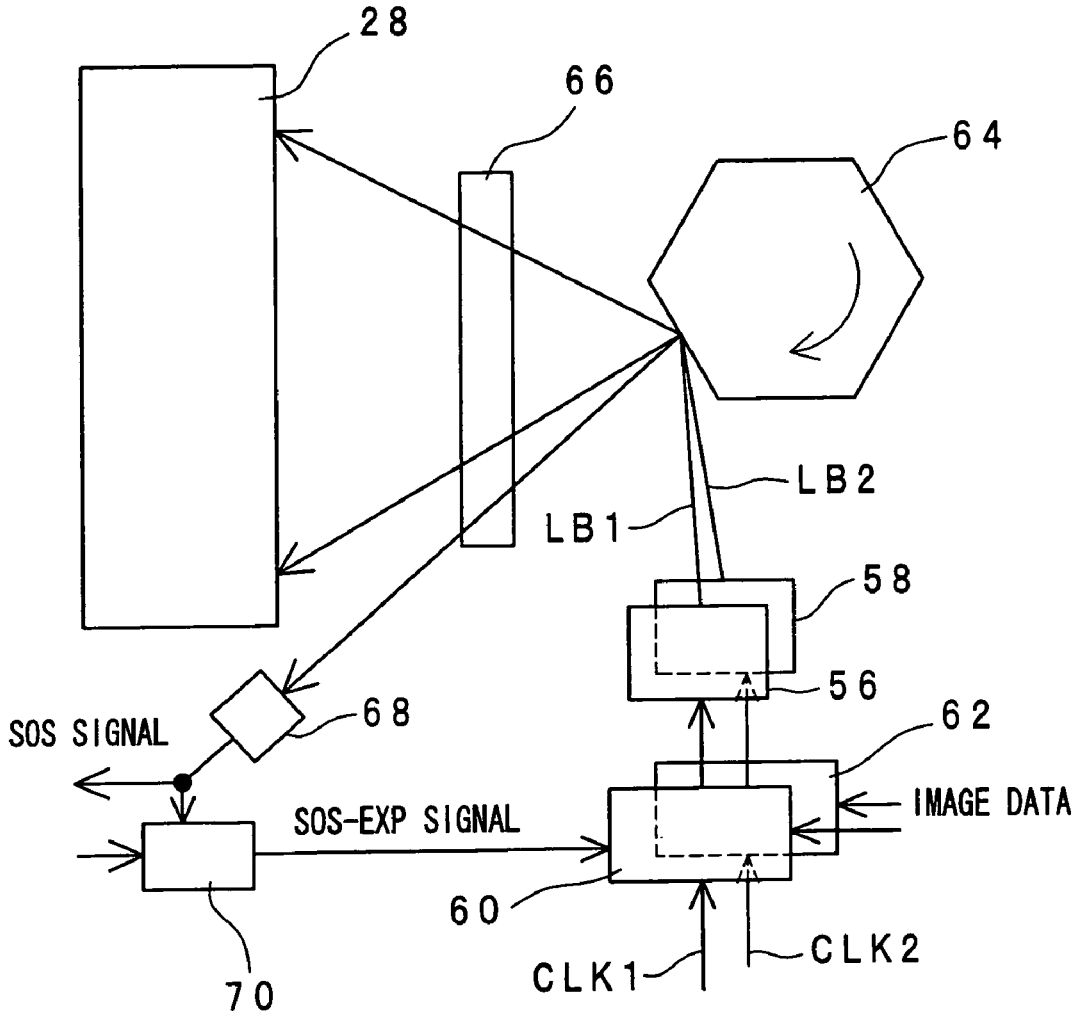
FIG. 2 is a structure view showing a main part of an exposure device.

FIG. 2 shows the structure of a main part of the exposure device 38. The exposure device 38 has four sets of the main part shown in FIG. 2 for the respective image forming units 26C, 26M, 26Y, 26K. The maim part of the exposure device 38 is composed of an LD 56 (first exposure light source), an LD 58 (second exposure light source), LD drive circuits 60, 62 for respectively driving the LD 56, LD 58, a rotating polygonal mirror 64 rotationally driven by an unshown motor at a constant speed for reflecting and deflecting laser beams LB1, LB2 emitted from the LD 56, LD 58, a fθ lens 66 for keeping horizontal scanning speeds of the laser beams LB1, LB2 on the surface of the photoreceptor 28 constant, an SOS sensor 68 for receiving the laser beam LB1 through the fθ lens 66 and outputting an SOS (Start of Scan) signal upon reception, an SOS sensor control section 70 for outputting an SOS-EXP signal, which causes cyclic mandatory light emission from the LD 56 at a specified time, to an LD drive circuit 60, and an unshown pixel clock signal control section for feeding pixel clock signals CLK1, CLK2 to the respective LD drive circuits 60, 62. It is to be noted that the SOS signal is a signal to determine image write timing for the laser beams LB1, LB2 on the surface of the photoreceptor 28, and the SOS sensor control section 70 stops outputting the SOS-EXP signal upon detection of the SOS signal.

Image data on odd number of lines are inputted into the LD drive circuit 60 one line at a time from the image memory, whereas image data on even number of lines are inputted into the LD drive circuit 62 one line at a time from the image memory. Upon reception of the SOS-EXP signal from the SOS sensor control section 70, the LD drive 60 causes mandatory light emission from the LD 56, and at the image write timing after termination of the SOS-EXP signal, the LD drive circuits 60, 62 execute digital-to-analog conversion of the image data on each line one pixel at a time in synchronization with the pixel clock signals CLK1, CLK2, and use the analog signals to directly drive the LDs 56, 58 so that light-modulated laser beams LB1, LB2 are emitted from the LDs 56, 58. The laser beams LB1, LB2 reflected and deflected by a mirror plane of the rotating polygonal mirror 64 rotationally driven at a constant speed pass through the fθ lens 66 and perform horizontal scanning of the surface of the photoreceptor 28 at constant intervals in vertical scanning direction. By this, an electrostatic latent image is formed on the surface of the photoreceptor 28.

Figure 3A:
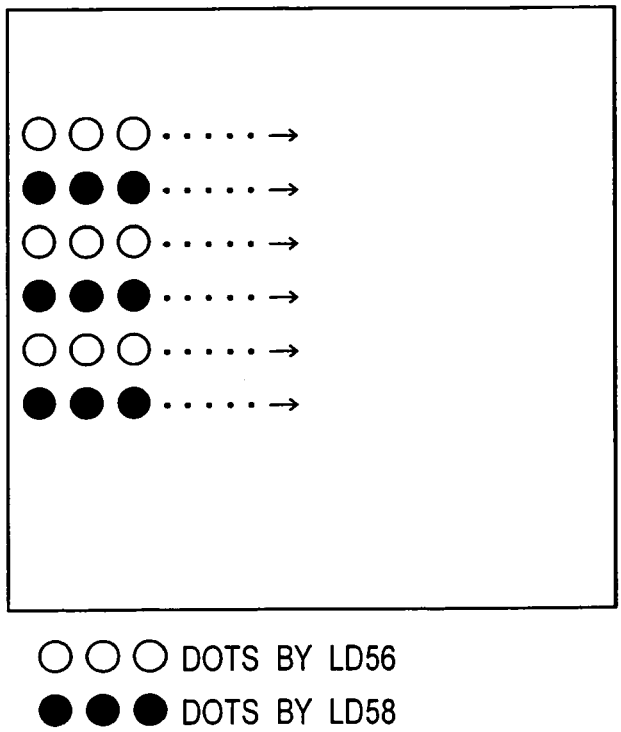
FIGS. 3A and 3B are views showing scanning states of two LDs.
Figure 3B:
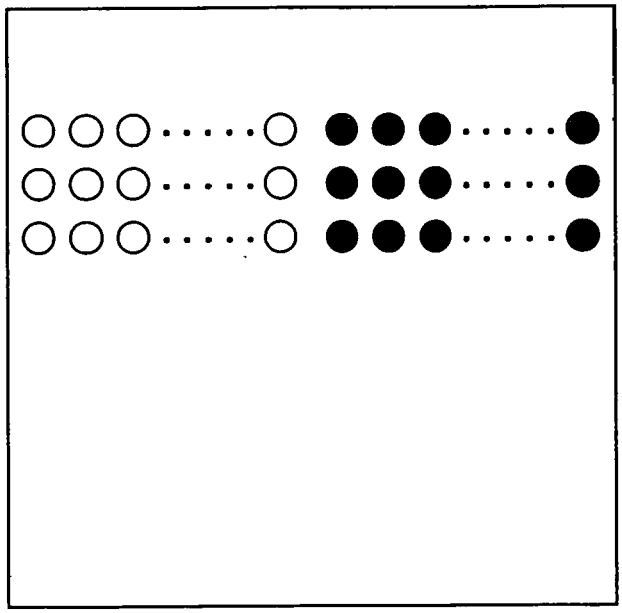

Although description has been given of the method in which the LD 56 forms dots constituting odd number of lines in an image and the $LD_{58}$ forms dots constituting even number of lines in the image as shown in FIG. 3A, the image forming method involving two LDs 56, 58 is not limited thereto, and a method in which, for example, two LDs 56, 58 each form half of the dots representing the same line as shown in FIG. 3B is also possible.

Description is now given of a color image forming operation in the thus-structured copier 10.

When an original document is loaded on the automatic document feed section 12 and a user presses a start button on an operation panel (unshown), the document sheets are transported one by one onto the platen glass 18 in the image scanner section 14, and the scanner optical system 20 in the image scanner section 14 operates to scan the document image.

The image data of the scanned document image is resolved into image data of CMYK four colors in the image processing section 22, and each image data is subject to necessary processings such as shading correction, density conversion and edge reinforcement and is temporarily stored in an image memory. Then, the each data is read out one line at a time from the image memory and used as a drive signal to cause laser emission from the LDs 56, 58 in the exposure device 38 according to need.

In each of the image forming units 26C, 26M, 26Y, 26K, the surface of the uniformly electrified photoreceptor 28 by the electrifier 30 is exposed to laser light emitted from the LDs 56, 58 so that an electrostatic latent image is formed, and the formed electrostatic latent image is developed with the toner of each color to be a toner image.

A paper sheet is fed from any one of the paper feed sections 40, 42, 44 selected automatically or according to users instruction to the paper transportation line 48, transported upward and retained on the surface of the transfer belt 24. Then, the paper sheet is transported through the respective image forming units 26C, 26M, 26Y, 26K as the transfer belt 24 rotates. In this transportation process, four color toner images formed in the respective image forming units 26C, 26M, 26Y, 26K are sequentially transferred from the photoreceptors 28 to the paper sheet so as to be laid on top of each other with electrostatic force by the transfer charger 34.

Then, when the paper sheet passes the fixing device 52, the toner image is heated and fixed thereon, and thereafter the paper sheet is discharged onto the paper discharge tray 54.

Description is now given of the exposure control in the copier 10 in the present invention.

In the exposure control, first, specified toner patterns are formed at a specified time on the transfer belt 24 with use of the LD 56 and the LD 58 through the aforementioned image forming operation. Although the specified time is a time corresponding to at least one of a time when the photoreceptor 28 has been replaced, a time when dot reproducibility has been changed due to deterioration in durability of the image forming units 26C, 26M, 26Y, 26K due to long period of use, and a time when surrounding environment has been changed beyond a specified value (e.g., when temperature has been changed by 10° C. or more), the specified time is not limited thereto.

Figure 4A:
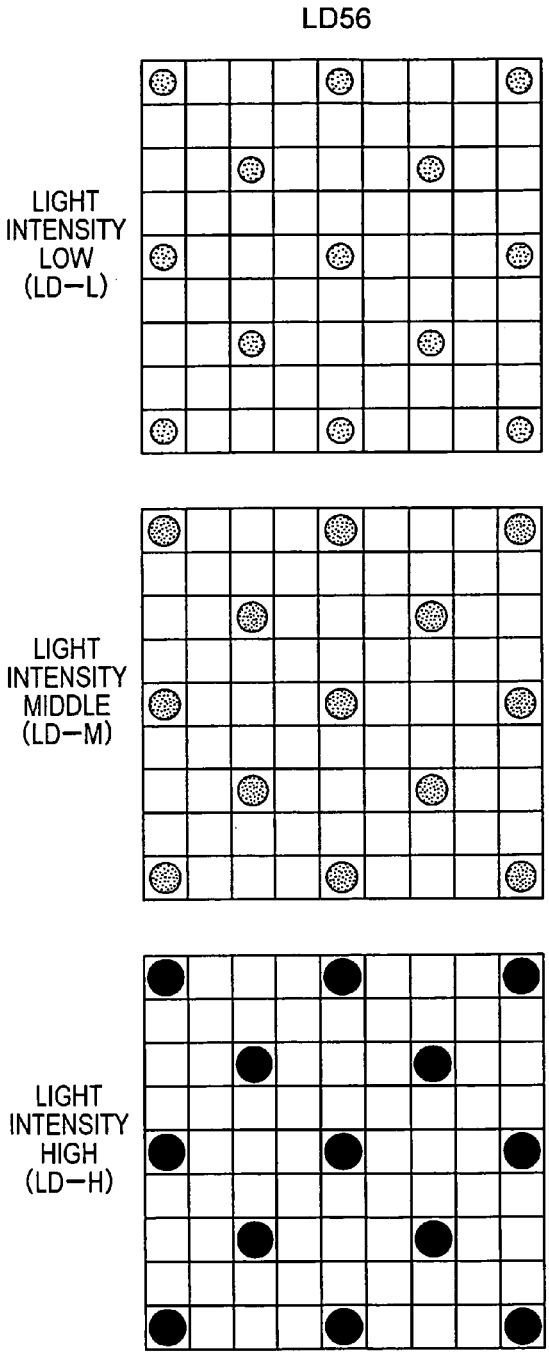
FIGS. 4A and 4B are views showing toner patterns for use in exposure control.
Figure 4B:
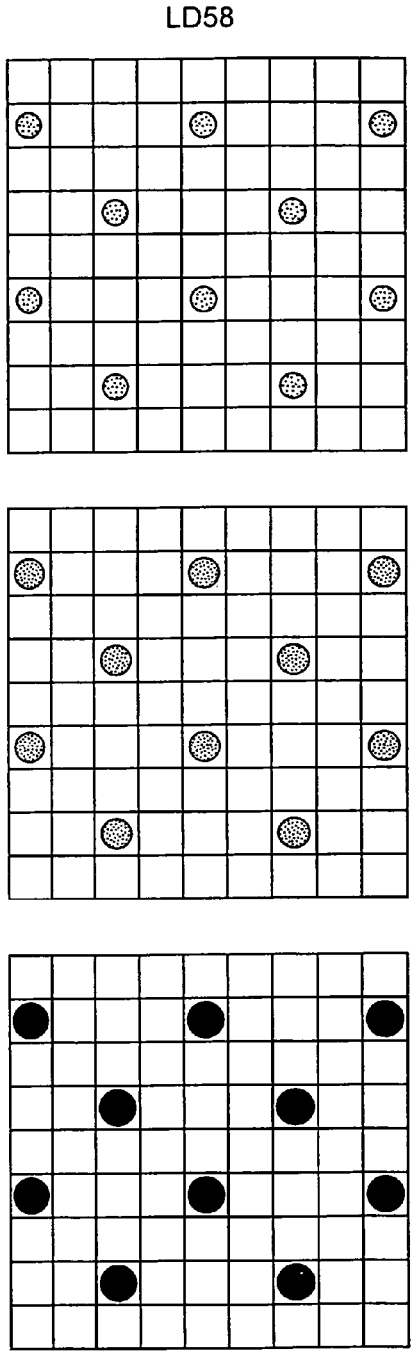

More specifically, the specified toner patters are, as shown in FIGS. 4A and 4B, slant ladder patterns in which one on-dot and three off-dots are aligned in horizontal scanning direction (horizontal direction as viewed in the drawing). The LD 56 forms, as shown in FIG. 4A, the slant ladder pattern in which dots are disposed in odd number of lines, whereas the LD 58 forms, as shown in FIG. 4B, the slant ladder pattern in which dots are disposed in even number of lines. It is to be noted that the patterns used in the exposure control are not limited to the slant ladder patterns and other patterns are usable.

The slant ladder patterns are formed for CMYK four colors with the intensity of light emitted from the LDs 56, 58 being divided into three levels: light intensity low (LD-L); light intensity middle (LD-M); and light intensity high (LD-H). More specifically, 3×4=12 slant ladder patterns are formed for each of the LDs 56, 58, i.e., total 24 slant ladder patterns are formed. It is to be noted that without being limited to three levels, the intensity of light emitted from the respective LDs 56, 58 may be divided into four levels or more.

Figure 5:
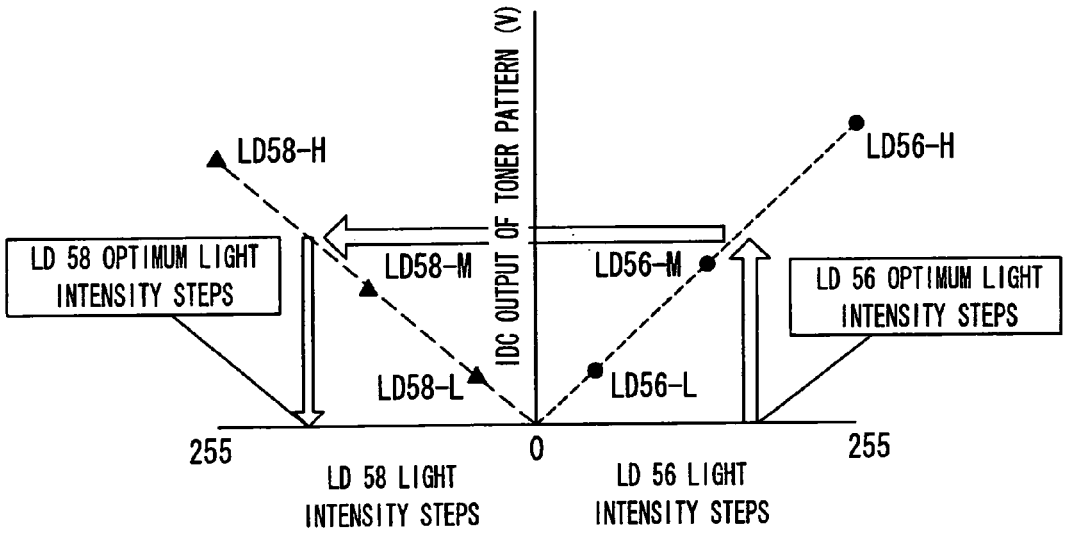
FIG. 5 is a view showing correlation between the two LDs.

Thus, the respective slant ladder patterns form toner patterns developed with toners of corresponding colors, and the densities of these toner patterns are respectively detected by the IDC sensor 50. An output result from the IDC sensor 50 is inputted into the controller 72. In the controller 72, a correlation between the LD 56 and the LD 58 as shown in FIG. 5 is attained for each of the CMYK four colors based on the detection result and the attained correlations are stored in the memory 74 of the controller 72. The correlation may be stored as an equation or as a table. It is to be noted that a horizontal axis in FIG. 5 shows light intensity steps, and since their drive signals are 8-bit signals, the respective LDs 56, 58 can be controlled in 256 steps from 0 to 255.

After the detection by the IDC sensor 50 is completed, each toner pattern is scraped off the transfer belt 24 by an unshown cleaner.

Thus, in the case where exposure control is performed by using the respective LDs 56, 58 at a specified time to form specified toner patterns, detecting the toner densities of the respective patterns formed by the two LDs 56, 58 and controlling the intensity of light emission from the respective LDs 56, 58 based on the detection result so as to attain an optimum toner density allows optimum control over the respective LDs 56, 58, which makes it possible to eliminate dispersion of dot reproducibility on the photoreceptor 28 in the respective LDs 56, 58 and to prevent generation of image noise.

In the case where image stabilization control is performed after the correlation between the LD 56 and the LD 58 is attained in the described way, twelve specified toner patterns (correction patterns) are formed with use of only the LD 56 that is one of the exposure light sources, the densities of these toner patterns is detected by the IDC sensor 50, and the optimum intensity of light emission from the LD 56 is determined by the controller 72 based on the detection result. As for the LD 58 that is the other exposure light source, a light intensity step of the LD 58 corresponding to the IDC output regarding the toner patterns in an optimum light intensity step in the LD 56 is determined as the optimum intensity of light emission in conformity with the stored correlation between the LD 56 and the LD 58 as shown in FIG. 5.

Thus, by attaining the correlation between the LD 56 and the LD 58 based on the detection result by the IDC sensor 50 and storing the attained correlation, the subsequent image stabilization control needs only the formation of toner patterns for exposure control with use of only the LD 56 and does not need the formation of toner patterns with use of the LD 58, which allows reduction in time taken for control operation and reduction in toner consumption amount.

Although the exposure device 38 has two LDs 56, 58 for each of the image forming units 26C, 26M, 26Y, 26K in this embodiment, the present invention is also applicable to image forming apparatuses including an exposure device having three or more exposure light sources for each of the image forming units 26C, 26M, 26Y, 26K.

Although the reflective photosensor 50 for detecting the densities of toner patterns is used in this embodiment, a potential sensor for detecting the potential of electrostatic latent images on the surface of the photoreceptor 28 may be used instead.

Moreover, although the copier 10 in this embodiment is structured such that toner images on the photoreceptors 28 of the respective image forming units 26C, 26M, 26Y, 26K are transferred onto a paper sheet transported by the transfer belt 24, the present invention is also applicable to a type of image forming apparatus in which toner images on the photoreceptors 28 of the respective image forming units 26C, 26M, 26Y, 26K are primary-transferred onto a belt-shaped or a dram-shaped intermediate transfer body and then secondary-transferred onto a paper sheet.

Moreover, the present invention is applicable not only to full-color image forming apparatuses but also to monochrome image forming apparatuses.

Further, the present invention is applicable to, in addition to copiers, various electrophotographic image forming apparatuses such as printers, facsimiles and complex machines composed of these machines and copiers.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus, comprising an image carrier;

an exposure device which performs exposure for forming a toner image on a surface of the image carrier and has at least a first exposure light source and a second exposure light source;

a sensor for detecting densities or potentials of a first set of specified patterns, which are formed on the image carrier at a specified time with use of the first exposure light source at a plurality of levels of intensity, and a second set of specified patterns, which are formed on the image carrier at the specified time with use of the second exposure light source at a plurality of levels of intensity;

a storing unit for storing respective relationships of the detected densities or potentials with the levels of intensity of the first exposure light source and the levels of intensity of the second exposure light source, which form a correlation between the first and second exposure light sources; and a controller for controlling intensity of the first and second exposure light sources based on the correlation.

2. The image forming apparatus according to claim 1, wherein a correction pattern is formed with use of the first exposure light source, densities or potentials of the correction pattern are detected by the sensor, a control value for the first exposure light source is determined based on the densities or potentials of the correction pattern detected by the sensor, and a control value for the second exposure light source is determined based on the control value for the first exposure light source in conformity with the attained correlation.

3. The image forming apparatus according to claim 1, wherein the first set and second set of specified patterns are toner patterns, and the sensor is a reflective photosensor for detecting densities of the toner patterns.

4. The image forming apparatus according to claim 1, wherein the first set and second set of specified patterns are electrostatic latent images, and the sensor is a potential sensor for detecting potentials of the electrostatic latent images.

5. The image forming apparatus according to claim 1, wherein the specified time is a time corresponding to at least one of a time when an image carrier has been replaced, a time when a long operation time has passed and a time when surrounding environment has changed beyond a specified value.

6. The image forming apparatus according to claim 1, wherein the image carrier is a photoreceptor or a transfer body.

7. The image forming apparatus according to claim 1, wherein a correlation between the first exposure light source and the second exposure light source is determined for each of CMYK four colors.

8. An exposure control method for an image forming apparatus having an exposure device which performs exposure for forming a toner image on a surface of an image carrier and has at least a first exposure light source and a second exposure light source, comprising the steps of:

forming a first set of specified patterns on the image carrier at a specified time with use of the first exposure light source at a plurality of levels of intensity, and a second set of specified patterns on the image carrier at the specified time with use of the second exposure light source at a plurality of levels of intensity;

detecting densities or potentials of the respective patterns by a sensor;

storing respective relationships of the detected densities or potentials with the levels of intensity of the first exposure light source and the levels of intensity of the second exposure light source, which form a correlation between the first and second exposure light sources; and controlling intensity of the first and second exposure light sources based on the correlation.

9. The exposure control method for an image forming apparatus according to claim 8, further comprising the steps of:

forming a correction pattern with use of the first exposure light source;

detecting densities or potentials of the correction pattern by the sensor;

determining a control value for the first exposure light source based on the densities or potentials of the correction pattern detected by the sensor; and determining a control value for the second exposure light source based on the control value for the first exposure light source in conformity with the attained correlation.

10. The exposure control method for an image forming apparatus according to claim 9, wherein the first set and second set specified patterns are toner patterns, and the sensor is a reflective photosensor for detecting densities of the toner patterns.

11. The exposure control method for an image forming apparatus according to claim 8, wherein the first set and second set specified patterns are electrostatic latent images, and the sensor is a potential sensor for detecting potentials of the electrostatic latent images.

12. The exposure control method for an image forming apparatus according to claim 8, wherein the specified time is a time corresponding to at least one of a time when an image carrier has been replaced, a time when a long operation time has passed and a time when surrounding environment has changed beyond a specified value.

13. The exposure control method for an image forming apparatus according to claim 8, wherein the image carrier is a photoreceptor or a transfer body.

14. The exposure control method according to claim 8, wherein a correlation between the first exposure light source and the second exposure light source is determined for each of CMYK four colors.

* * * * *